US008042506B2

(12) United States Patent
Shoji

(10) Patent No.: US 8,042,506 B2
(45) Date of Patent: Oct. 25, 2011

(54) CYLINDER HEAD

(75) Inventor: Junpei Shoji, Toyota (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 456 days.

(21) Appl. No.: 12/438,801

(22) PCT Filed: Aug. 31, 2007

(86) PCT No.: PCT/IB2007/002505

§ 371 (c)(1),
(2), (4) Date: Feb. 25, 2009

(87) PCT Pub. No.: WO2008/026055

PCT Pub. Date: Mar. 6, 2008

(65) Prior Publication Data

US 2009/0320784 A1 Dec. 31, 2009

(30) Foreign Application Priority Data

Aug. 31, 2006 (JP) ..... 2006-235195

(51) Int. Cl.
*F02F 1/24* (2006.01)

(52) U.S. Cl. ..... 123/90.27; 123/193.5

(58) Field of Classification Search ..... 123/90.27, 123/193.1–193.5

See application file for complete search history.

(56) References Cited

U.S. PATENT DOCUMENTS

| | | | | | |
|---|---|---|---|---|---|
| 4,291,650 | A | * | 9/1981 | Formia et al. | 123/90.27 |
| 4,612,885 | A | | 9/1986 | Yoshikawa | |
| 4,823,747 | A | | 4/1989 | Wagner et al. | |
| 5,080,057 | A | * | 1/1992 | Batzill et al. | 123/193.5 |
| 5,213,071 | A | | 5/1993 | Iwata et al. | |
| 6,083,140 | A | * | 7/2000 | Kimura | 477/115 |

FOREIGN PATENT DOCUMENTS

| | | | |
|---|---|---|---|
| DE | 39 12 495 | A1 | 10/1990 |
| JP | 63-143309 | A | 6/1988 |
| JP | 1-77516 | U | 5/1989 |
| JP | 8-326513 | A | 12/1996 |
| JP | 2004-92567 | A | 3/2004 |

* cited by examiner

*Primary Examiner* — M. McMahon
(74) *Attorney, Agent, or Firm* — Sughrue Mion, PLLC

(57) ABSTRACT

A cylinder head has a cylinder head body, a camshaft housing mounted on the cylinder head body, and cam caps mounted on the camshaft housing. The camshaft housing has through holes into which bolts are inserted to secure the camshaft housing and the cam caps together to the cylinder head body when assembling the engine. Internal threads are formed on the inner surfaces of the through hole, respectively. When rounding the cam holes before assembling the engine, second bolts are temporarily tightened to the internal threads of the through holes to secure the cam caps to the cam housing.

3 Claims, 5 Drawing Sheets

CYLINDER HEAD

BACKGROUND OF THE INVENTION

1. Field of the Invention

The invention relates to a cylinder head of an internal combustion engine, and more particularly to a cylinder head having a cylinder head body, a camshaft housing mounted on the cylinder head body, and cam caps mounted on the camshaft housing.

2. Description of the Related Art

Japanese Patent Application Publication No. 2004-92567 (JP-A-2004-92567) recites a cylinder block of an internal combustion engine having a cylinder head body mounted on the cylinder block of the engine, a camshaft housing mounted on the cylinder head body, and cam caps mounted on the camshaft housing. The camshaft housing has bearing portions for supporting the camshafts of the engine. The camshafts are rotatably supported by the bearing portions of the camshaft housing and the cam caps.

The reason for employing such a structure in which the cylinder head and the camshaft housing are separately provided is to improve the workability of mounting engine components on the engine. More specifically, on one side, the engine valves and some components of the valve drive mechanism are mounted to the cylinder head body, and on the other side, the camshafts are mounted to the bearing portions of the camshaft housing. Then, the camshaft housing is secured to the cylinder head body by several bolts, whereby the mounting of the valve drive mechanism to the cylinder head is completed. According to this method, thus, the workability of mounting the engine components to the engine improves.

Meanwhile, in order to rotatably support the camshafts, circular cam holes are formed between the camshaft housing and the respective cam caps. More specifically, the cam holes are formed by semi-circular bearing concave portions formed on the respective bearing portions of the camshaft housing and semi-circular bearing concave portions formed on the respective cam caps and facing the corresponding semi-circular bearing concave portions of the bearing portions of the camshaft housing. Each of these cam holes is required to have a predetermined level of roundness. Therefore, as mentioned above, it is necessary to round each cam hole before mounting the camshafts.

The rounding of the cam holes needs to be performed in a state that is the same as or similar to when the camshaft housing and the cam caps are actually mounted on the engine. That is, when the bolting points for bolting the camshaft housing and the cam caps and the tightening axial force for tightening each bolt are different from those when mounting the camshaft housing and the cam caps to the engine, even if the cam holes are rounded to achieve the predetermined level of roundness, the roundness of each cam hole may be reduced when the camshaft housing and the cam caps are mounted to the engine. Therefore, conventionally, the rounding of the cam holes is performed after mounting the camshaft housing and the cam caps to the cylinder head body or a dummy cylinder head body.

In this case, however, after rounding the cam holes, it is necessary to remove the camshaft housing and the cam caps from the cylinder head body or a dummy cylinder head body and then mount them again to the cylinder head body when assembling the engine. Thus, according to such a conventional cam hole rounding process, because the cylinder head body or a dummy cylinder head body is used when rounding the cam holes, the rounding process is costly and requires much work despite the fact that the camshaft housing and the cylinder head body are separately provided. Further, when a dummy cylinder head body is used to round the cam holes, the cost for the dummy cylinder head body increases the production cost.

SUMMARY OF THE INVENTION

The invention provides a cylinder head that minimizes the reduction of the roundness of each cam hole and simplifies the process for rounding the cam holes without making the structure of the camshaft housing complicated.

An aspect of the invention relates to a cylinder head having a cylinder head body, a camshaft housing mounted on the cylinder head body, and a cam cap mounted on the camshaft housing, a cam hole for supporting a camshaft being defined between the camshaft housing and the cam cap. According to this cylinder head, the camshaft housing has a through hole into which a first bolt is inserted to secure the camshaft housing and the cam cap together to the cylinder bead body when assembling an engine, and the through hole has an internal thread which is formed on the inner surface of the through hole and to which a second bolt is temporarily tightened to secure the cam cap to the cam. housing when processing the cam hole before assembling the engine.

According to the cylinder head described above, the camshaft housing and the cam cap are secured together to the cylinder head when assembling the engine. At this time, the first bolt is inserted into the through hole. On the other hand, when processing the cam hole before assembling the engine, the cam cap is secured to the camshaft housing. At this time, the second bolt is temporarily tightened to the internal thread formed on the inner surface of the through hole. During this, by tightening the second bolt by a tightening axial force equal to the tightening axial force by which the first bolt is tightened, the rounding of the cam hole can be performed in a state that is the same as or similar to when the camshaft housing and the cam cap are actually mounted on the engine. According to this structure, therefore, it is possible to minimize the reduction of the roundness of the cam hole that may occur when the camshaft and the cam cap are mounted on the engine. That is, if the cam hole is rounded to achieve a predetermined level of roundness as mentioned above, the achieved roundness can be maintained even after the camshaft housing and the cam cap are mounted on the engine. According to the above-described cylinder head, therefore, it is possible to simplify the process for rounding the cam hole and save the cost and effort for rounding the cam hole.

Further, in the cylinder head described above, the through hole is used as the thread hole to which the second bolt is tightened when rounding the cam hole before mounting the camshaft housing and the cam cap to the engine, as well as the inert hole into which the first bolt is inserted when mounting the camshaft housing and the cam cap to the engine. Thus, with the through hole being used as both the insert hole for the first bolt and the thread hole for the second bolt, the structure of the camshaft housing is not complicated.

As such, with the above-described cylinder head, it is possible to minimize the reduction of the roundness of the cam hole and simplify the process for rounding the cam hole without making the structure of the camshaft housing complicated.

The above-described cylinder head may be such that the camshaft housing has a pair of frame portions extending in the axial direction of the camshaft and a bearing portion extending from one of the frame portions to the other of the frame portions and the cam cap is mounted on the top face of the bearing portion.

Further, in this cylinder head, each of the frame portions may have an wall portion that extends upward to a position higher than the mating face between the bearing portion and the cam cap. In this case, the rigidity of the camshaft housing is further increased, and therefore the possibility of the camshaft housing being warped when rounding the cam hole can be minimized and thus the reduction of the accuracy in rounding the cam hole can be minimized. As such, the reduction of the coaxially of the cam hole that may occur when mounting the camshaft housing and cam cap to the engine can be reduced.

As mentioned above, with the cylinder head of the invention, it is possible to minimize the reduction of the roundness of the cam hole and simplify the process for rounding the cam hole without making the structure of the camshaft housing complicated.

BRIEF DESCRIPTION OF THE DRAWINGS

The features, advantages thereof, and technical and industrial significance of this invention will be better understood by reading the following detailed description of preferred embodiments of the invention, when considered in connection with the accompanying drawings, in which.

DETAILED DESCRIPTION OF THE EMBODIMENTS

Hereinafter, an exemplary embodiment of the invention will be described with reference to the accompanying drawings. The following description will be made of the cylinder block of an inline four-cylinder engine (will be simply referred to as "engine").

Figure 1:
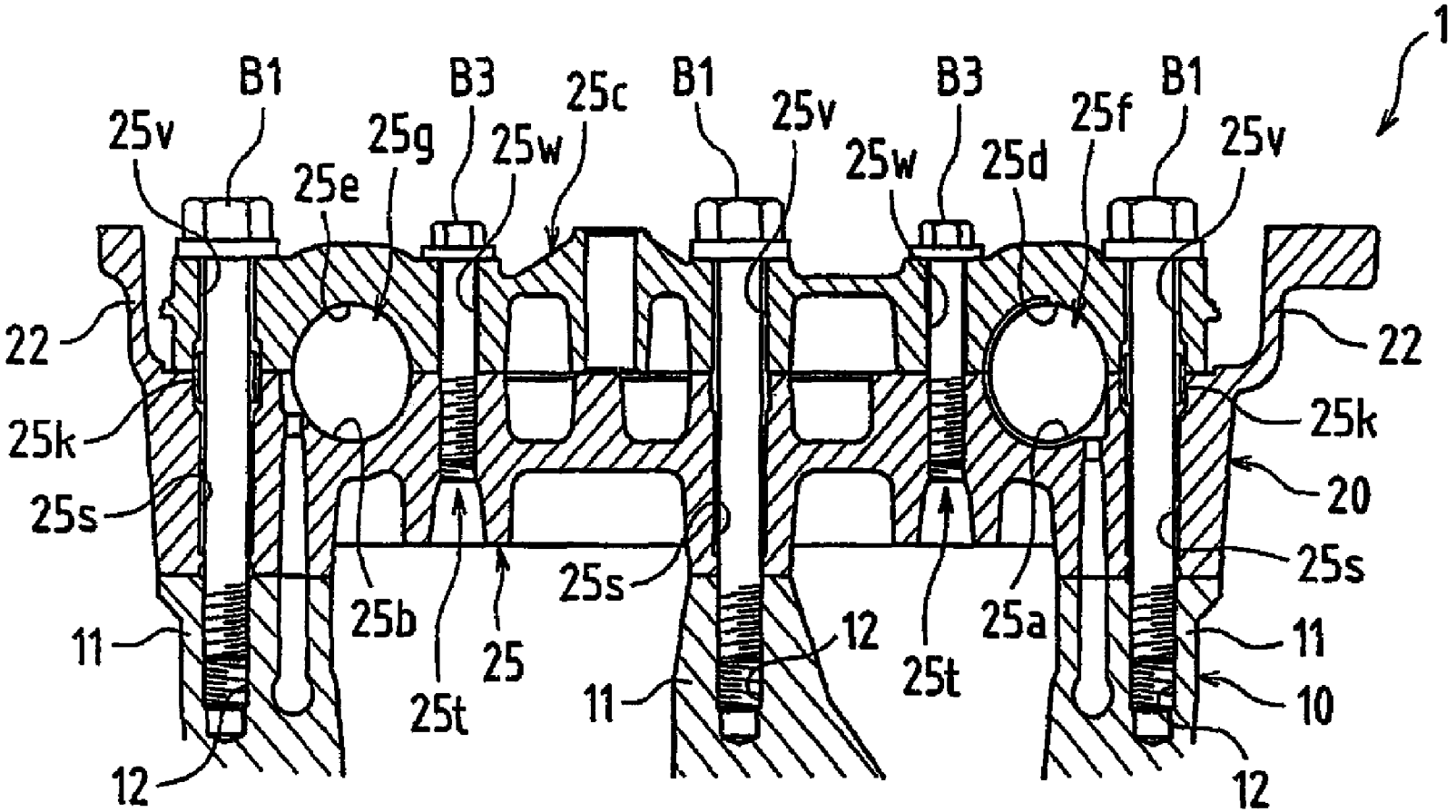
FIG. 1 is a cross-sectional view showing a cylinder head that is constituted of a cylinder head body, a camshaft housing, and cam caps, the cam shaft housing and the cam caps being mounted on the cylinder head body.
Figure 2:
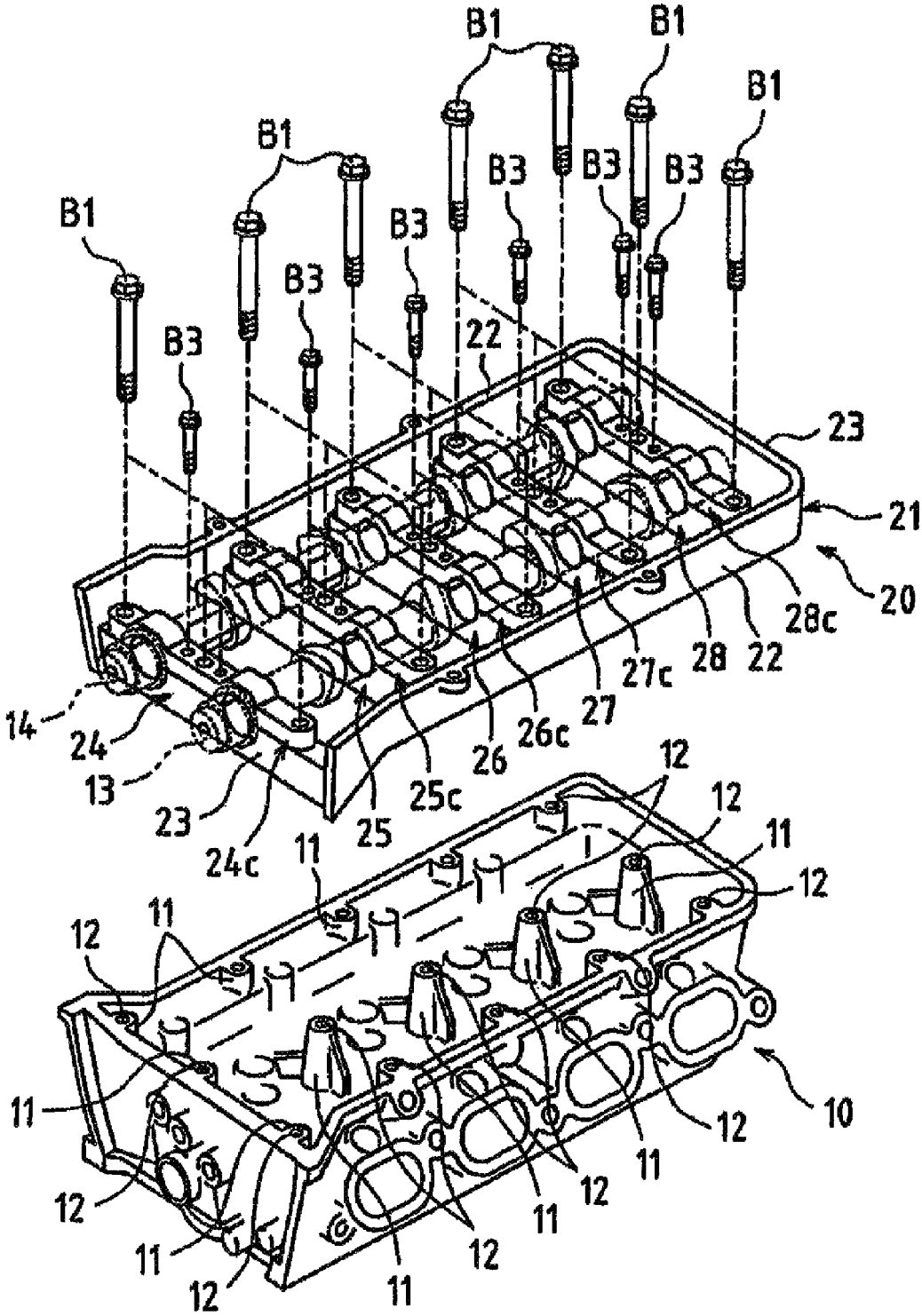
FIG. 2 is a perspective view schematically illustrating how the camshaft housing and the cam caps are secured to the cylinder head body when assembling the engine.
Figure 3:
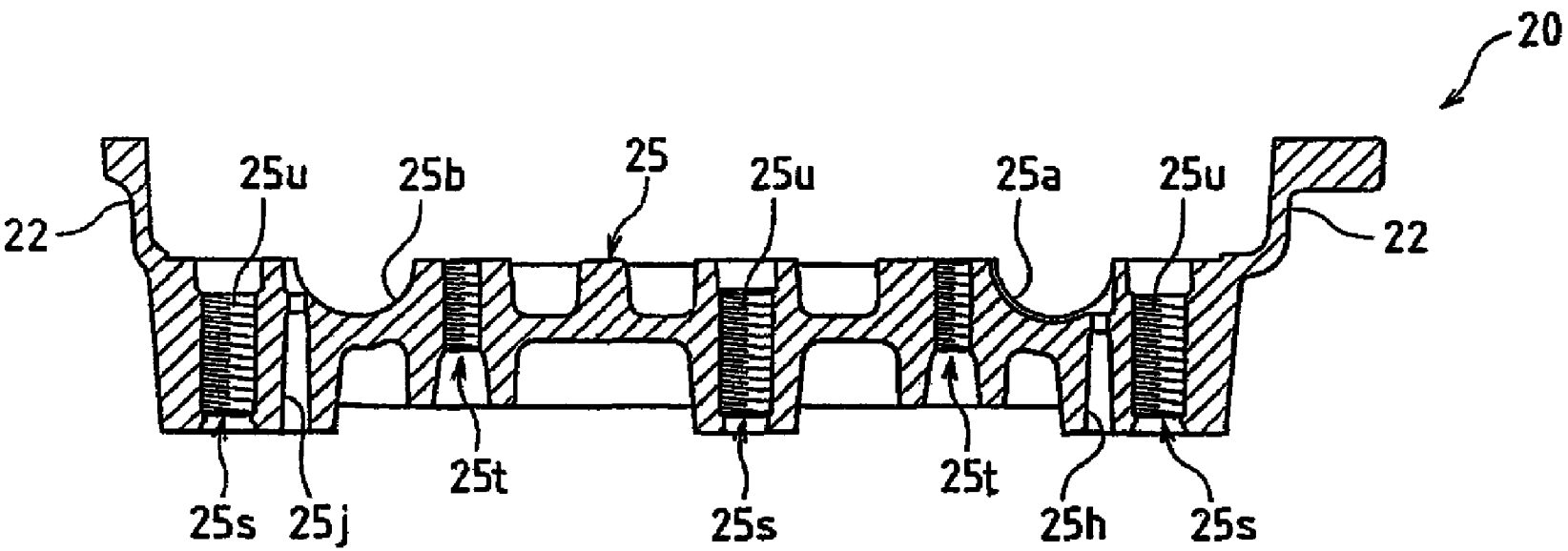
FIG. 3 is a cross-sectional view of the camshaft housing.
Figure 4:
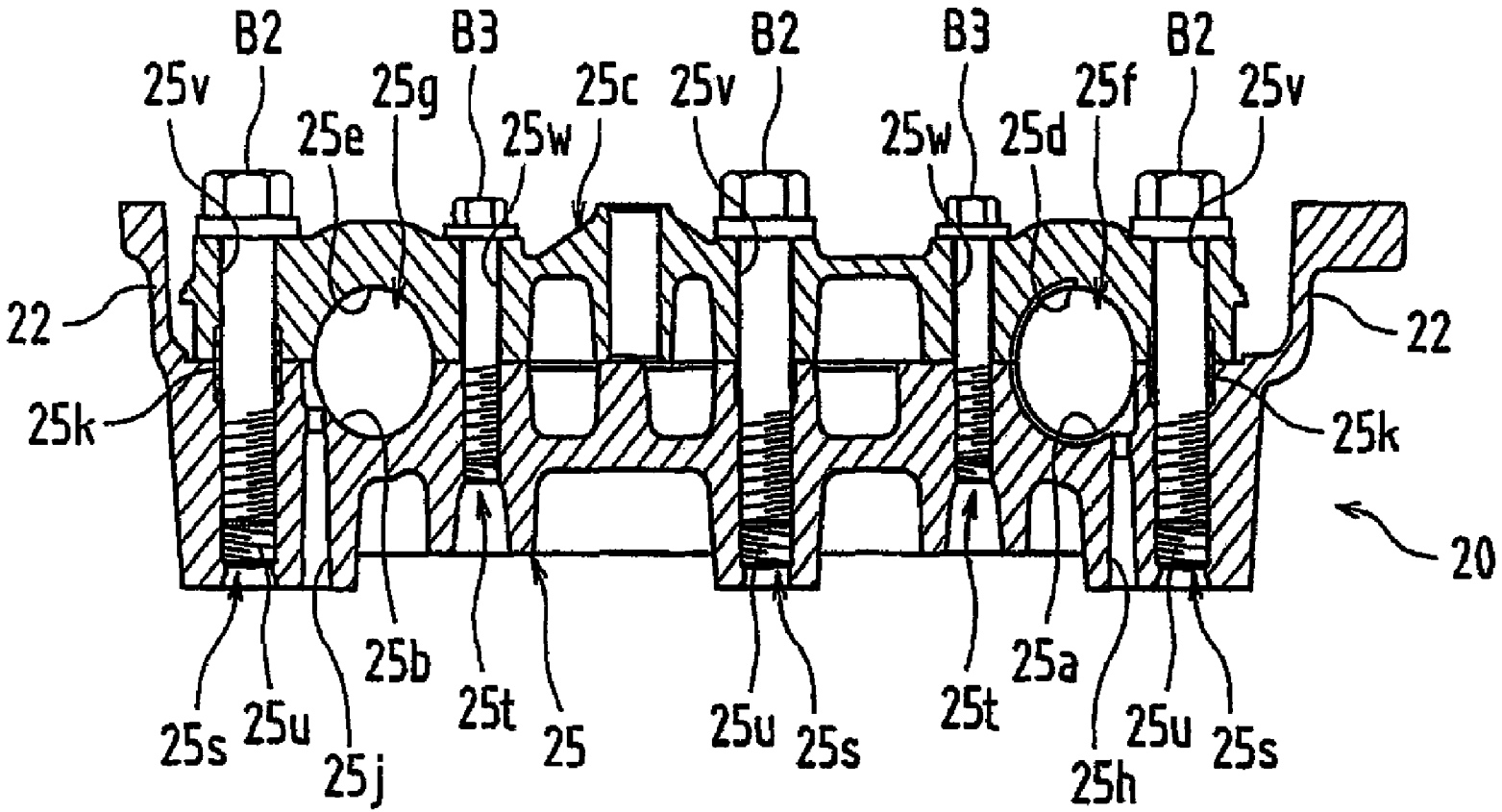
FIG. 4 is a cross-sectional view showing a state where the cam hole rounding process is performed to the camshaft housing on which the cam caps are mounted.
Figure 5:
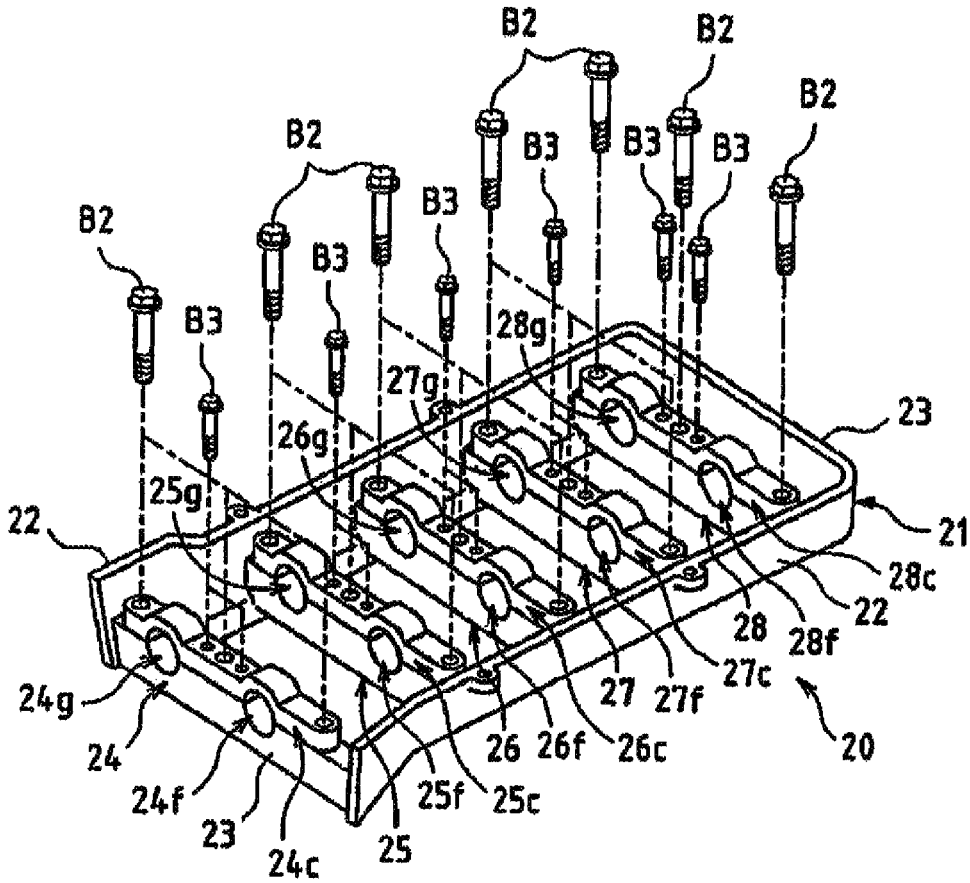
FIG. 5 is a perspective view schematically showing how the cam caps are secured to the camshaft housing.

FIG. 1 is a cross-sectional view showing a cylinder head 1 that is constituted of a cylinder head body 10, a camshaft housing 20, cam caps 24*c* to 28*c*. The camshaft housing 20 and the cam caps 24*c* to 28*c* are mounted on the cylinder head body 10. FIG. 2 is a perspective view schematically illustrating how the camshaft housing 20 and the cam caps 24*c* to 28*c* are mounted to the cylinder head body 10. FIG. 3 is a cross-sectional view of the camshaft housing 20. FIG. 4 is a cross-sectional view showing a state where the cam hole rounding process is performed to the camshaft housing 20 on which the cam caps 24*c* to 28*c* are mounted. FIG. 5 is a perspective view schematically showing how the cam caps 24*c* to 28*c* axe secured to the cam housing 20. FIG. 1, FIG. 3, and FIG. 4 show only a second bearing portion 25 among bearing portions 24 to 28 of the camshaft housing 20 and only the cam cap 25*c* mounted on the second bearing portion 25 among the cam caps 24*c* to 28*c*. Note that the structures of other bearing portions 24, 26, 27, 28 of the camshaft housing 20 and other cam caps 24*c*, 26*c*, 27*c*, 28*c* are the same as those of the second bearing portion 25 and the cam cap 25*c*.

The cylinder head 1 is mounted on the cylinder block of the internal combustion engine. The cylinder head 1 is constituted of the cylinder head body 10 mounted on the cylinder block and the camshaft housing 20 mounted on the cylinder head body 10. Thus, in the cylinder head 1, the cylinder head body 10 and the camshaft housing 20 are separately provided.

The cylinder bead body 10 is secured to the cylinder block by bolts. The cylinder head body 10 is made of, for example, aluminum alloy. Engine valves (intake valves and exhaust valves) and components of a valve drive mechanism are mounted in the cylinder head body 10.

The cylinder head body 10 has boss portions 11 at which thread holes 12 are formed, respectively. When mounting the camshaft housing 20 and the cam caps 24*c* to 28*c* to the engine, bolts B1 are tightened to the thread holes 12 to mount the camshaft housing 20 and the cam caps 24*c* to 28*c* together to the cylinder head body 10. The camshaft housing 20 and the cam caps 24*c* to 28*c* are made of, for example, aluminum alloy. A more detailed description will later be made of how the bolts B1 are tightened to secure the camshaft housing 20 and the cam caps 24*c* to 28*c* to the cylinder head body 10.

An intake camshaft 13 for driving the intake valves and an exhaust camshaft and an exhaust camshaft 14 for driving the exhaust valves are rotatably supported by the camshaft housing 20. The camshaft housing 20 has a flame 21 that is an outer frame of the camshaft housing 20. The outline of the frame 21 substantially matches the outline of the cylinder head body 10. More specifically, the frame 21 has a pair of first frame portions 22 that extend in the direction in which the crankshaft extends (i.e., the axial directions of the intake cam shaft 13 and the exhaust cam shaft 14), that is, in the longitudinal direction of the frame 21, and a pair of second frame portions 23 that extend in the direction perpendicular to the direction in which the crankshaft extends, that is, in the lateral direction of the frame 21. Having the first frame portions 22 and the second frame portions 23, the frame 21 is formed in a rectangular shape as viewed from above.

Each bearing portion 24 to 28 extends between the two first frame portions 22 across the space therebetween. The bearing portions 24 to 28 extend perpendicular to the direction in which the crankshaft extends. In this exemplary embodiment, the bearing portions 24 to 28 are provided at five positions, respectively, two at the ends of the camshaft housing 20 in the longitudinal direction thereof and three at the positions corresponding to the regions between the cylinders. The first frame portions 22 and the second frame portion 23 on the rear side of the engine have wall portions extending upward to the position higher than the top faces of the bearing portions 24 to 28.

Hereinafter, the first to fifth bearing portions 24 to 28 of the camshaft housing 20 will be described in detail. In the following description, for convenience of description, the cylinder located at the leftmost position in FIG. 2 and FIG. 5 (the position on the front side of the engine) is denoted a first cylinder, and the cylinders on the right of the first cylinder (on the rear side of the engine) are sequentially denoted a second cylinder, a third cylinder, and a fourth cylinder.

The first bearing portion 24 is formed on the front side of the position above the first cylinder. The first bearing portion 24 is integrated with the second frame portion 23 provided at, the front end of the engine. The second bearing portion 25 is provided between the position above the first cylinder and the position above the second cylinder. The third bearing portion 26 is provided between the position above the second cylinder and the position above the third cylinder. The fourth bearing portion 27 is provided between the position above the third cylinder and the position above the fourth cylinder The fifth bearing portion 28 is provided on the rear side of the position above the fourth cylinder. The second to fifth bearing portions 25 to 28 have a common structure. Although the structure of the first bearing portion 24 is basically the same as those of the second to fifth bearing portions 25 to 28, the first bearing portion 24 is slightly longer than the second to fifth bearing portions 25 to 28 because the first frame portions 22 are slanted outward at the position of the first bearing portion 24.

The first to fifth bearing portions 24 to 28 have intake side bearing concave portions 24*a* to 28*a* for supporting the intake cam shaft 13 and exhaust side bearing concave portions 24*b* to 28*b* for supporting the exhaust cam shaft 14, respectively. The intake side bearing concave portions 24*a* to 28*a* and the exhaust side bearing concave portions 24*b* to 28*b* each have a semi-circular cross section. Further, the first to fifth bearing portions 24 to 28 have oil holes 24*h* to 28*h* through which lubricant is supplied to the intake side bearing concave portions 24*a* to 28*a*, respectively, and oil holes 24*j* to 28*j* through which lubricant is supplied to the exhaust side bearing concave portions 24*b* to 28*b*, respectively.

The cam caps 24*c* to 28*c* are secured on the first to fifth bearing portions 24 to 28 using bolts B1, B3, respectively, so as to cover the upper side of the intake cam shaft 13 and the upper side of the exhaust cam shaft 14. A more detailed description as to how the cam caps 24*c* to 28*c* are bolted to the first to fifth bearing portions 24 to 28 will be made later.

The cam caps 24*c* to 28*c* have intake side bearing concave portions 24*d* to 28*d* for supporting the intake camshaft 13 and exhaust side bearing concave portions 24*e* to 28*e* for supporting the exhaust camshaft 14. The intake side bearing concave portions 24*d* to 28*d* and the exhaust side bearing concave portions 24*e* to 28*e* each have a semi-circular cross section. In this exemplary embodiment) each of the cam caps 24*c* to 28*c* has a portion for supporting the intake camshaft 13 and a portion for supporting the exhaust camshaft 14 and these portions are integrated with each other. That is, each cam cap 24*c* to 28*c* extends from the end of the corresponding bearing portion 24 to 28 on the intake camshaft 13 side to the end of the same bearing portion 24 to 28 on the exhaust camshaft 14 side.

The intake side bearing concave portions 24*a* to 28*a* of the first to fifth bearing portions 24 to 28 and the intake side bearing concave portions 24*d* to 28*d* of the cam caps 24*c* to 28*c* are arranged to face each other such that circular intake side cam holes 24*f* to 28*f* are formed by the intake side bearing concave portions 24*a* to 28*a* and the exhaust side bearing concave portions 24*b* to 28*b*, respectively. The bearing portions of the intake camshaft 13 are fit in the intake side cam holes 24*f* to 28*f*, respectively, whereby the intake camshaft 13 is rotatably supported. Likewise the exhaust side bearing concave portions 24*b* to 28*b* of the first to fifth bearing portions 24 to 28 and the exhaust side bearing concave portions 24*e* to 28*e* of the cam caps 24*c* to 28*c* are arranged to face each other such that circular exhaust side cam holes 24*g* to 28*g* are formed by the exhaust side bearing concave portions 24*b* to 28*b* and the exhaust side bearing concave portions 24*e* to 28*e*. The bearing portions of the exhaust camshaft 14 are fit in the exhaust side cam holes 24*g* to 28*g*, respectively, whereby the exhaust camshaft 14 is rotatably supported.

Next, a description will be made of how the cylinder head body 10, the camshaft housing 20, and the cam caps 24*c* to 28*c* are secured to each other.

First, thread holes, insert holes, and so on, that are formed in the camshaft housing 20, the earn caps 24*c* to 28*c*, and the cylinder head body 10, respectively, will be described.

Through holes 24*s* to 28*s* and thread holes 24*t* to 28*t* are vertically formed in the first to fifth bearing portions 24 to 28 of the camshaft housing 20 such that the through holes 24*s* to 28*s* and the thread holes 24*t* to 28*t* penetrate the first to fifth bearing portions 24 to 28, respectively. More specifically, three through holes 24*s* to 28*s* are provided at each bearing portion 24 to 28, two at the ends of the bearing portion and one at the center of the bearing portion, and two thread holes 24*t* to 28*t* are formed at each bearing portion 24 to 28, one at one side of the through hole formed at the center of the bearing portion and one at the other side of the same through hole. Thus, at the first to fifth bearing portions 24 to 28, the through holes 24*s* to 28*s* and the thread holes 24*t* to 28*t* are alternately provided. Internal threads 24*u* to 28*u* are formed on the inner surfaces of the through holes 24*s* to 28*s*, respectively. The inner diameter of each thread hole 24*t* to 28*t* is smaller than the inner diameter of each through hole 24*s* to 28*s* (the inner diameter measured at the internal thread 24*u* to 28*u*). As will be described later in detail, when mounting the camshaft housing 20 and the cam caps 24*c* to 28*c* to the engine, the bolts B1 are inserted into the through holes 24*s* to 28*s*, respectively. On the other hand, when rounding the cam holes before mounting the camshaft housing 20 and the cam caps 24*c* to 28*c* to the engine, the bolts B2 are temporarily tightened to the internal threads 24*u* to 28*u* of the through holes 24*s* to 28*s*. The bolts B3 are tightened to the thread holes 24*t* to 28*t* when mounting the camshaft housing 20 and the cam caps 24*c* to 28*c* to the engine and when rounding the cam holes before mounting the camshaft housing 20 and the cam caps 24*c* to 28*c* to the engine. The diameter of each through hole 24*s* to 28*s* measured above the internal thread 24*u* to 28*u* is slightly larger than the diameter measured at the internal thread 24*u* to 28*u*.

Insert holes 24*v* to 28*v* and insert holes 24*w* to 28*w* are vertically formed in the cam caps 24*c* to 28*c* mounted on the first to fifth bearing portions 24 to 28 of the camshaft housing 20, respectively, such that the insert holes 24*v* to 28*v* and the insert holes 24*w* to 28*w* penetrate the cam caps 24*c* to 28*c*. The insert holes 24*v* to 28*v* are provided as insert holes corresponding to the through holes 24*s* to 28*s* of the first to fifth bearing portions 24 to 28 of the camshaft housing 20. The insert holes 24*v* to 28*v* are provided above the through holes 24*s* to 28*s*, respectively. More specifically, three insert holes 24*v* to 28*v* are formed in each cam cap 24*c* to 28*c*, two at the ends of the cam cap and one at the center of the cam cap. The insert holes 24*w* to 28*w* are provided as insert holes corresponding to the thread holes 24*t* to 28*t* of the first to fifth bearing portions 24 to 28 of the camshaft housing 20. The insert holes 24*w* to 28*w* are provided above the thread holes 24*t* to 28*t*. More specifically, two insert holes 24*w* to 28*w* are formed at each cam cap 24*c* to 28*c*, one at one side of the insert hole 24*v* to 28*v* formed at the center of the cam cap and one at the other side of the same insert hole 24*v* to 28*v*. The diameter of each insert hole 24*w* to 28*w* is smaller than the diameter of each insert hole 24*v* to 28*v*. As will be described later, the bolts B1 are inserted into the insert holes 24*v* to 28*v*, respectively, when mounting the camshaft housing 20 and the cam caps 24*c* to 28*c* to the engine, and the bolts B2 are temporarily inserted into the insert holes 24*v* to 28*v*, respectively when rounding the cam holes before mounting the camshaft housing 20 and the cam caps 24*c* to 28*c* to the engine. The bolts B3 are inserted into the insert holes 24*w* to 28*w*, respectively, when mounting the camshaft housing 20 and the cam caps 24*c* to 28*c* to the engine and when rounding the cam holes before mounting the camshaft housing 20 and the cam caps 24*c* to 28*c* to the engine.

The cylinder head body to has the boss portions 11 at which the thread holes 12 are vertically formed. The thread holes 12 are provided at the positions corresponding to the through holes 24*s* to 28*s* of the camshaft housing 20. The thread holes 12 are provided below the respective through holes 24*s* to 28*s*. The inner diameter of each thread hole 12 is smaller than the diameter of each through hole 24*s* to 28*s* (the inter diameter measured at the internal thread 24*u* to 28*u*). As will be described in detail, the bolts B1 are tightened to the thread holes 12, respectively, when mounting the camshaft housing 20 and the cam caps 24*c* to 28*c* to the engine.

The diameter of the bolts B1 is set such that they can be inserted into the through holes 24*s* to 28*s* of the first to fifth bearing portions 24 to 28 of the camshaft housing 20. The diameter of the bolts B2 is set such that they can be tightened to the internal threads 24*u* to 28*u* of the through holes 24*s* to 28*s*. Further, the length of the bolts B1 is set such that the camshaft housing 20 and the cam caps 24*c* to 28*c* are secured together to the cylinder head body 10 by the bolts B1. The length of the bolts B2 is set such that the cam cap 24*c* to 28*c* are secured to the camshaft housing 20 by the bolts B2. Thus, the bolt B1 have a smaller diameter and a larger length than the bolt B2. Thus, to cope with the difference in diameter between the bolts B1 and the bolts B2, when rounding the cam holes before mounting the camshaft housing 20 and the cam caps 24*c* to 28*c* to the engine, the bolts B2 are tightened with a tightening torque that is adjusted such that the tightening axial force for tightening each bolt B2 equals the tightening axial force for tightening each bolt B1.

When mounting the camshaft housing 20 and the cam caps 24*c* to 28*c* to the engine, the camshaft housing 20 and the cam caps 24*c* to 28*c* are together secured to the cylinder head body 10 using the bolts B1, B3. More specifically, at this time, the bolts B1 are inserted into the insert holes 24*v* to 28*v* of the cam caps 24*c* to 28*c* and into the through holes 24*s* to 28*s* of the first to fifth bearing portions 24 to 28 and then tightened to the thread holes 12 of the cylinder head body 10, and the bolts B3 are inserted into the insert holes 24*w* to 28*w* of the cam caps 24*c* to 28*c* and then tightened to the thread holes 24*t* to 28*t* of the first to fifth bearing portions 24 to 28. Two cylindrical members 24*k* to 28*k* for locating each cam cap 24*c* to 28*c* in its appropriate position on the top face of the corresponding bearing portion 24 to 28 are provided at the ends of the same bearing portion 24 to 28. The lower ends of the cylindrical members 24*k* to 28*k* are inserted into the large diameter portions above the internal threads 24*u* to 28*u* of the through holes 24*s* to 28*s* while the upper ends of the cylindrical members 24*k* to 28*k* protrude from the top faces of the first to fifth bearing portions 24 to 28. The inner diameter of the cylindrical portion 24*k* to 28*k* is equal to the inner diameter of the through hole 24*s* to 28*s* (the inner diameter measured at the internal thread 24*u* to 28*u*).

Assuming that the diameter of the through hole 24*s* to 28*s* is equal to the diameter of the thread hole 12, because the internal threads 24*u* to 28*u* are formed on the inner surfaces of the through holes 24*s* to 28*s*, if the phases of the internal threads 24*u* to 28*u* are not aligned with the phases of the corresponding thread holes 12, the bolts B1 can not be tightened to the thread holes 12. However, in this exemplary embodiment, the diameter of the bolts B1 is set to a value that allows the bolts B1 to be inserted into the respective through holes 24*s* to 28*s* and the bolts B1 are not tightened to the internal threads 24*u* to 28*u*. Therefore, even if the phases of the internal threads 24*u* to 28*u* are not aligned with the phases of the corresponding thread holes 12, the bolts B1 can be properly tightened to the respective thread holes 12. Further, the thread-cutting for forming the internal threads 24*u* to 28*u* on the inner surfaces of the through holes 24*s* to 28*s* can be easily performed regardless of the phase of each thread hole 12.

Meanwhile, when rounding the cam holes before mounting the camshaft housing 20 and the cam caps 24*c* to 28*c* to the engine, the cam caps 24*c* to 28*c* are secured to the camshaft housing 20 using the bolts B2, B3. More specifically, the bolts B2 are inserted into the insert holes 24*v* to 28*v* of the cam caps 24*c* to 28*c* and then tightened to the internal threads 24*u* to 28*u* of the through holes 24*s* to 28*s* of the first to fifth bearing portions 24 to 28 of the camshaft housing 20, respectively. At this time, each bolt B2 is tightened to the internal thread 24*u* to 28*u* by a tightening axial force equal to the tightening axial force by each bolt B1 is tightened to the thread hole 12 when mounting the camshaft housing 20 and the cam caps 24*c* to 28*c* to the engine. Then, the bolts B3 are inserted into the insert holes 24*w* to 28*w* of the cam caps 24*c* to 28*c* and then tightened to the thread holes 24*t* to 28*t* of the first to fifth bearing portions 24 to 28. At this time, each bolt B3 is tightened by a tightening axial force equal to the tightening axial force by which each bolt B3 is tightened when mounting the camshaft housing 20 and the cam caps 24*c* to 28*c* to the engine. During this, the cylindrical members 24*k* to 28*k* are put in the through holes 24*s* to 28*s* at both ends of each bearing portion 24 to 28 as they are when mounting the camshaft housing 20 and the cam caps 24*c* to 28*c* to the engine as described above.

In order to achieve a predetermined level of roundness of each cam hole (i.e., each of the intake side cam holes 24*f* to 28*f* for rotatably supporting the intake cam shaft 13 and the exhaust side cam holes 24*g* to 28*g* for rotatably supporting the exhaust cam shaft 14), a process for rounding the cam holes is performed before mounting the intake care shaft 13 and the exhaust cam shaft 14. In this exemplary embodiment, the cam hole rounding process is performed to the camshaft housing 20 after securing the cam caps 24*c* to 28*c* to the camshaft housing 20 and fixing the camshaft housing 20 by cramping it in a certain position. More specifically, the camshaft housing 20 is cramped at several points of the frame 21 of the camshaft housing 20, for example, at three points; one at the one end of the engine front side of the frame 21, one at the other end of the engine front side of the frame 21, and one at the center of the engine rear side of the frame 21. Next, the cam hole rounding process is performed to the intake side cam holes 24*f* to 28*f* at one time, and then to the exhaust side cam holes 24*g* to 28*g* at one time. After rounding the cam holes, the bolts B2, B3 are removed and the cam caps 24*c* to 28*c* are removed from the camshaft housing 20.

According to the cylinder head 1 described above, unlike in the conventional cases, the cam hole rounding process can be performed without using the cylinder head body 10 or a dummy cylinder head body. More specifically because the intake side cam holes 24*f* to 28*f* and the exhaust side cam holes 24*g* to 28*g* are required to have a predetermined level of roundness, it is necessary to round these cam holes before mounting the intake camshaft 13 and the exhaust camshaft 14. When rounding the cam holes, the cam caps 24*c* to 28*c* are secured to the camshaft housing 20 by tightening the bolts B3 to the thread holes 24*t* to 28*t* of the first to fifth bearing portions 24 to 28 of the camshaft housing 20 and tightening the bolts B2 to the internal threads 24*u* to 28*u* formed in the through holes 24*s* to 28*s* of the first to fifth bearing portions 24 to 28 of the camshaft housing 20. At this time, the bolts B2, B3 are tightened to the same number of points as the points to which the bolts B1, B3 are tightened when mounting the camshaft housing 20 and the cam caps 24*c* to 28*c* to the engine, and the bolts B2, B3 are tightened by tightening axial forces that are equal to the tightening axial forces by which the bolts B1, B3 are tightened when mounting the camshaft housing 20 and the cam caps 24*c* to 28*c* to the engine.

Thus, according to this exemplary embodiment, the cam hole rounding process can be performed in a state that is the same as or similar to when the camshaft housing 20 and the cam caps 24*c* to 28*c* are actually mounted on the engine. As such, it is possible to minimize the reduction of the roundness of each cam hole that may occur when the camshaft housing 20 and the cam caps 24*c* to 28*c* are actually mounted to the engine. That is, if the intake side cam holes 24*f* to 28*f* and the exhaust side cam holes 24*g* to 28*g* are rounded so as to achieve the predetermined level of roundness of each cam hole by the foregoing cam hole rounding process, the achieved roundness of each cam hole can be maintained even after the camshaft housing 20 and the cam caps 24*c* to 28*c* are mounted to the engine.

According to the exemplary embodiment, thus, by performing the foregoing cam hole rounding process to the camshaft housing 20 with the cam caps 24*c* to 28*c* mounted thereon, the cam holes can be properly rounded without using the cylinder head body 10 or a dummy cylinder head body. Therefore, when rounding the camp holes, the work for mounting the cam caps 24*c* to 28*c* to the camshaft housing 20 and removing the cam caps 24*c* to 28*c* from the camshaft housing 20 afterward can be easily done as compared to the case where the camshaft housing 20 and the cam caps 24*c* to 28*c* are mounted to and then removed from the cylinder head body 10 or a dummy cylinder head body. As a result, the process for rounding the cam holes is simplified and therefore the cost and effort for rounding the cam holes can be saved. Thus, the structure of the cylinder head 1 is suitable for mass-produced engines.

Further, the internal threads 24*u* to 28*u* are formed on the inner surfaces of the through holes 24*s* to 28*s* of the first to fifth bearing portions 24 to 28 of the camshaft housing 20. The through holes 24*s* to 28*s* are used as the thread holes to which the bolts B2 are temporarily tightened when performing the cam hole rounding process before mounting the camshaft housing 20 and the cam caps 24*c* to 28*c* to the engine, as well as the insert holes into which the bolts B1 are inserted when mounting the camshaft housing 20 and the cam caps 24*c* to 28*c* to the engine. That is, with the through holes 24*s* to 28*s* being used as both the insert holes for the bolts B1 and the thread holes for the bolts B2, the structure of the camshaft housing 20 is not complicated.

Thus, according to the cylinder head 1 of this exemplary embodiment, it is possible to achieve a desired roundness of each cam hole 24*f* to 28*f* and 24*g* to 28*g* while simplifying the process for rounding the cam holes without making the structure of the camshaft housing 20 complicated.

Meanwhile, when the cam holes are rounded without using the cylinder head body 10 or a dummy cylinder head body, the center portion of the camshaft housing 20 may be warped downward with respect to the end portions of the camshaft housing 20 due to its own weight. Because the camshaft housing 20 is not warped when it is mounted on the cylinder head body 10, such warping of the camshaft housing 20 during the cam hole rounding process may reduce the coaxiality of each of the intake side cam holes 24*f* to 28*f* and the exhaust side cam holes 24*g* to 28*g*, that is, it may reduce the accuracy in rounding the cam holes.

In this exemplary embodiment, however, because the first frame portions 22 and the second frame portions 23 of the camshaft housing 20 extend upward to the position higher than the top faces of the first to fifth bearing portions 24 to 28, that is, to the position higher than the mating faces between the first to fifth bearing portions 24 to 28 and the cam caps 24*c* to 28*c*, the rigidity of the camshaft housing 20 is high and this reduces the possibility of the camshaft housing 20 being warped when performing the foregoing cam hole rounding process. As such, the aforementioned reduction of the accuracy in rounding the cam holes can be prevented or minimized, that is, the aforementioned reduction of the coaxiality of each cam hole 24*f* to 28*f* and 24*g* to 28*g* can be prevented or minimized.

While the engine in the foregoing exemplary embodiment is an inline four-cylinder engine, the engine may alternatively be an engine having a different number of cylinders and/or having a different cylinder layout (e.g., V-type engines boxer engines).

Further, while the five bearing portions 24 to 28 are provided in the camshaft housing 20, the number of the bearing portions may be changed as needed according to, for example, the number of cylinders of the engine.

Further, the number, arrangement, and so on, of the through holes 24*s* to 28*s* provided in the camshaft housing 20 for the bolts B1, B2 and the thread holes 24*t* to 28*t* provided in the camshaft housing 20 for the bolts B3 are not limited to those in the foregoing exemplary embodiment. For example, the thread holes 24*t* to 28*t* formed in the first to fifth bearing portions 24 to 28 for the bolts B3 may be omitted. That is, only the through holes 24*s* to 28*s* for the bolts B1, B2 may be provided in the first to fifth bearing portions 24 to 28. Further, the number and positions of the through holes for the bolts B1, B2 and the thread holes for the bolts B3 may be different between two or more of the first to fifth bearing portions 24 to 28. Further, the inner diameter of the thread holes 24*t* to 28*t* for the bolts B3 may be equal to or larger than the inner diameter of the through holes 24*s* to 28*s* for the bolts B1, B2. That is, the size of the bolts B3 may be equal to or larger than the bolts B1, B2. Note that, in any case, the insert holes in the cam caps need to be formed as insert holes corresponding to the through holes and thread holes of the bearing portions.

Further, while the cam caps 24*c* to 28*c* are a cam cap having integrated intake and exhaust side portions in the foregoing exemplary embodiment, they may alternatively be a cam cap constituted of separate intake and exhaust side portions.

While the invention has been described with reference to the example embodiment thereof, it is to be understood that the invention is not limited to the example embodiment and construction. To the contrary, the invention is intended to cover various modifications and equivalent arrangements. In addition, while the various elements of the example embodiment are shown in various combinations and configurations, which are exemplary, other combinations and configurations, including more, less or only a single element, are also within the sprit and scope of the invention.

The invention claimed is:

1. A cylinder head having a cylinder head body, a camshaft housing mounted on the cylinder head body, and a cam cap mounted on the camshaft housing, a cam hole for supporting a camshaft being defined between the camshaft housing and the cam cap, comprising:

the camshaft housing has a through hole into which a first bolt is inserted to secure the camshaft housing and the cam cap together to the cylinder head body when assembling an engine, and the through hole has an internal thread which is formed on the inner surface of the through hole and to which a second bolt is temporarily tightened to secure the cam cap to the camshaft housing when processing the cam hole before assembling the engine.

2. The cylinder head according to claim 1, wherein the camshaft housing has a pair of frame portions extending in the axial direction of the camshaft and a bearing portion extending from one of the frame portions to the other of the frame portions, and the cam cap is mounted on the top face of the bearing portion.

3. The cylinder head according to claim 2, wherein each of the frame portions has a wall portion extending upward to a position higher than the mating face between the bearing portion and the cam cap.

* * * * *